US010300487B2

(12) United States Patent
Reis et al.

(10) Patent No.: US 10,300,487 B2
(45) Date of Patent: May 28, 2019

(54) PIPETTE HOLDER

(71) Applicant: Biosurfit, S.A., Azambuja (PT)

(72) Inventors: Nuno Alexandre Esteves Reis, Lisbon (PT); Miguel João Marques Barreiros, Lisbon (PT); Tania Moura Pires de Andrade Tenreiro, Lisbon (PT)

(73) Assignee: Biosurfit, S.A., Azambuja (PT)

( * ) Notice: Subject to any disclaimer, the term of this patent is extended or adjusted under 35 U.S.C. 154(b) by 0 days.

(21) Appl. No.: 15/646,679

(22) Filed: Jul. 11, 2017

(65) Prior Publication Data

US 2019/0015836 A1 Jan. 17, 2019

(51) Int. Cl.
*B01L 9/00* (2006.01)
*B01L 3/02* (2006.01)

(52) U.S. Cl.
CPC ..... *B01L 9/54* (2013.01); *B01L 3/021* (2013.01); *B01L 2200/0605* (2013.01); *B01L 2200/12* (2013.01); *B01L 2300/0838* (2013.01); *B01L 2400/0406* (2013.01)

(58) Field of Classification Search
None
See application file for complete search history.

(56) References Cited

U.S. PATENT DOCUMENTS 1,647,039 A * 10/1927 Fischer ..... G01N 9/14 248/309.1
2,129,617 A * 9/1938 Hill ..... G01N 25/04 73/451
3,062,380 A * 11/1962 Grela ..... B01L 9/06 211/73
3,154,078 A * 10/1964 Goodrich, Jr. .... A61M 25/1018 604/920
3,203,540 A * 8/1965 Kalt ..... B01L 9/54 206/486
3,217,891 A * 11/1965 Weaver ..... B01L 9/54 211/60.1
3,320,686 A * 5/1967 Blackburn ..... G01V 7/14 273/447
3,379,315 A * 4/1968 Broadwin ..... B01L 3/0217 211/189
4,124,122 A * 11/1978 Emmitt ..... B01L 9/06 211/74
4,160,803 A * 7/1979 Potts ..... B01L 9/54 206/509
4,588,095 A * 5/1986 Mehra ..... B01L 9/06 211/126.1
5,036,989 A * 8/1991 Carilli ..... B01L 9/06 211/60.1
7,125,727 B2 * 10/2006 Massaro ..... B01L 3/022 436/180

(Continued)

*Primary Examiner* — Jill A Warden
*Assistant Examiner* — Brittany I Fisher

(57) ABSTRACT

A holder for a pipette having a bulb is disclosed. In use, the bulb of the pipette is inserted into the holder and the user can hold the holder rather than the bulb to use the pipette. In this way, the holder enables the pipette to be held without any application of force from the user directly on the bulb. This enables the user to accurately draw a desired amount of liquid into the pipette. The holder comprises an aperture through which the bulb is accessible. The user can dispense liquid from the pipette by actuating the bulb through the aperture.

14 Claims, 6 Drawing Sheets

(56) References Cited

U.S. PATENT DOCUMENTS

| | | | | |
|---|---|---|---|---|
| 7,171,736 | B1 * | 2/2007 | Kennon | A62C 13/78<br>169/51 |
| 7,357,899 | B2 * | 4/2008 | Gaillard | B01L 3/0206<br>222/283 |
| 8,906,327 | B2 * | 12/2014 | Williams | B01L 9/543<br>422/524 |
| 9,642,778 | B1 * | 5/2017 | Yazbeck | A61J 15/0061 |
| 2005/0161414 | A1 * | 7/2005 | Wescott, III | B01L 9/06<br>211/74 |
| 2007/0163973 | A1 * | 7/2007 | Smokowicz | A01G 5/04<br>211/70 |
| 2008/0060719 | A1 * | 3/2008 | Massaro | G01N 35/0099<br>141/237 |
| 2014/0348724 | A1 * | 11/2014 | Panetz | G01N 35/1074<br>422/509 |

* cited by examiner

PIPETTE HOLDER

FIELD OF THE DISCLOSURE

The invention relates to a holder for a pipette, in particular a holder for retaining a bulb of the pipette.

BACKGROUND OF THE DISCLOSURE

Pipettes are used for transport and/or measurement of quantities of liquid, for example in a laboratory. Pipettes such as volumetric pipettes, Pasteur pipettes or transfer pipettes comprise a stem and a bulb. The stem is arranged with an opening to receive liquid that is stored in the stem. In some pipettes, the bulb is used to draw liquid into the stem. In some pipettes, liquid is drawn into the stem by capillary action. In some pipettes of this kind, the stem is provided with an air hole and the volume of liquid drawn into the stem can be controlled by positioning the air hole because liquid fills the stem by capillary action until it reaches the air hole. Generally, the bulb may be actuated to release liquid stored in the stem.

Care must be taken by a user of the pipette to accurately control liquid flow into and out of the pipette. Handling a pressure-actuated pipette is a demanding operation for the human brain and requires fine motor skills from the user. One difficulty involves gripping a round surface (i.e. of the bulb) while controlling the pressure applied to ensure that the bulb is not squeezed inadvertently during handling. Another difficulty in handling is due to the spatial accuracy required at the same time to direct the opening of the pipette to collect and deposit a liquid sample. For example, when depositing a liquid sample into a sample testing device, this must be done without losing grip on the pipette yet adequately exerting just the right pressure to ensure controlled dispensing of the liquid. If the sample is loaded into the device with too much pressure, there is a high risk of spilling and wasting the liquid sample. Furthermore, for small sample volumes, after depositing the sample, the user must remove the pipette without releasing the bulb; otherwise a significant volume of sample may be drawn back up into the stem.

SUMMARY OF THE DISCLOSURE

In overview, a holder for a pipette, a sheet comprising a plurality of holders, a kit comprising a holder and a pipette, as well as a method of manufacturing a plurality of pipette holders are disclosed.

In one aspect, a holder for a pipette having a bulb is disclosed. The pipette holder comprises a front member defining a first aperture, a back member, and a first spacer and a second spacer. The front and back members may be substantially parallel to each other. The first and second spacers are each connected to the front member and the back member to space apart the front member and the back member. At least part of the first aperture is between the first spacer and the second spacer. The front member, the back member, the first spacer and the second spacer define a space for receiving the bulb of the pipette. Once the bulb is inserted into the space, the bulb may be retained in the holder through an interference fit. In other words, the diameter of the bulb may slightly exceed the internal dimension of the space.

The holder enables a user to hold the pipette more securely as it provides for additional rigidity. The front and back members may be substantially flat, thereby providing surfaces around the bulb that are easier to grip compared to the round surfaces of the bulb. It may also enable the user to more accurately control the liquid drawn into and released from the pipette. For example, if the pipette is configured to draw a predetermined amount of liquid into its stem by capillary action, any actuation of the bulb when drawing liquid in to the pipette will vary the amount of liquid actually taken up in the stem. The holder provides areas for the user to support the pipette without directly applying any force on the bulb. Instead, any force applied by the user to grip the holder is transferred around the bulb. To deposit liquid from the pipette, the user can squeeze the bulb which is accessible through the first aperture. Additionally, the first aperture limits the access of the user to the bulb, thereby limiting the amount of pressure that the user can exert on the bulb. This increases the accuracy of dispensing of any liquid in the pipette. The restricted access to the bulb reduces the risk of the user inadvertently exerting excessive pressure. This may help the user to control the way in which any liquid sample is dispensed.

The first spacer may be connected to the front member away from a first edge of the front member to form a first flange, and the second spacer is connected to the front member away from a second edge of the front member to form a second flange. The spacers and back member may form flanges in an analogous fashion. The first and second edges of the front member may each comprise a remainder of a frangible connection. In some embodiments, at least part of the first aperture is in the first flange and in the second flange. The first and second spacers may have cut-outs in the region of the first aperture. In use, the absence of structural support from the first and second spacers in the regions of the first aperture enables the holder to be more easily squeezed to apply force to the bulb of the pipette.

Optionally, the back member defines a second aperture at least partially between the first spacer and the second spacer. The second aperture may be substantially the same shape and substantially the same size as the first aperture and may substantially coincide with the first aperture, subject to manufacturing tolerances. In some embodiments, the first and second apertures have been cut by a single cutting action, enabling simpler manufacture.

The first aperture may have any shape, for example the first aperture may comprise four sides and may have rounded corners between adjacent sides. In some particular embodiments, two facing corners between the spacers and the other two facing corners extend into the respective flanges. Advantageously, this shape facilitates manufacture by cutting the two apertures and corresponding portion of the spaces in a single cutting action. In some embodiments, the first aperture comprises an elliptical shape, to similar effect.

Optionally, the front member and the back member are integrally formed with the first spacing element and the second spacing element, for example by extrusion, in a particular example extrusion of a sheet material such as an alveolar material.

In another aspect, a sheet comprising a plurality of holders as described above is provided. In the sheet, pairs of adjacent holders are connected by a frangible connection. The frangible connection may be broken to separate a holder from the sheet to enable the holder to be used. The frangible connection (and optionally the apertures) may result from cuts in the sheet material.

In another aspect, a kit is provided. The kit comprises a pipette having a bulb, and the holder as described above. The bulb of the pipette is an interference fit in the space defined by the front member, the back member, the first spacer and the second spacer.

The pipette may be a transfer pipette, i.e. a plastic pipette known in the art that has an integrally formed bulb and stem. As the force required to actuate the bulb of transfer pipettes may not be significantly larger than the force required to grip the transfer pipette, the holder provides a means for gripping the transfer pipette without actuating the bulb.

The pipette may comprise a stem with an internal dimension sized such that liquid may be drawn into the stem by capillary action. The stem may comprise an air hole in the stem The air hole may act to limit or substantially prevent capillary driven liquid ingress into the stem beyond the air hole. As a result a well-defined volume of liquid can be drawn into the stem by capillary action. As the bulb would not need to be actuated in order to draw liquid into the pipette, the holder provides a means for gripping the pipette without actuating the bulb, facilitating the measurement of a predetermined amount of liquid, as explained above. The pipette may be suitable for transporting a liquid volume of less than 10, 20, 25, 35, 50 or 100 microliters. For example, the pipette may be substantially as described in U.S. Pat. Nos. 5,460,782 or 6,531,098 which are both incorporated by reference herein.

In yet another aspect, a method of manufacturing a plurality of pipette holders is provided. The method comprises receiving a sheet of sheet material. The sheet material may be an alveolar material. The sheet comprises a front face, a back face; and a plurality of regularly spaced spacers each connected to the front face and the back face to space apart the front face and the back face. The method comprises cutting the front face to form a plurality of apertures, with at least part of each of the plurality of apertures between two adjacent spacers. The method comprises cutting the front face and the back face between each aperture to separate the pipette holders. For example, the front and back faces may be cut to form a frangible connection between each aperture, or the pipette holders may be completely separated by the cuts. The method enables quick and easy manufacture of a plurality of pipette holders. In those embodiments where frangible connections remain, the method provides a convenient way of supplying a plurality of pipettes.

Cutting the front face to form a plurality of apertures and/or cutting the front face and the back face between each aperture, for example to form a frangible connection between each aperture may be carried out using a laser cutter, a water jet, a blade or a saw.

The method may comprise cutting the back face to form a corresponding aperture for each of the plurality of apertures, wherein at least part of each of the corresponding apertures is between two adjacent spacers. The method may comprise cutting through the sheet to form a plurality of pair of (first and second) apertures in the front and back faces in a single cutting action. Naturally, the sheet may be cut in the same way to separate the pipette holders/form the frangible connections.

The apertures may be arranged in various ways on the same sheet, for example in one or more rows.

BRIEF DESCRIPTION OF THE FIGURES

Specific embodiments are now described by way of example with reference to the drawings, in which.

DETAILED DESCRIPTION OF THE DISCLOSURE

The disclosure provides a holder for a pipette having a bulb. In use, the bulb of the pipette is inserted into the holder and the user can hold the holder rather than the bulb to use the pipette. In this way, the holder enables the pipette to be held without any application of force directly on the bulb. This enables a user to accurately draw a desired amount of liquid into the pipette, in particular when this happens by capillary force. The holder comprises an aperture through which the bulb is accessible. The user can dispense liquid from the pipette by actuating the bulb through the aperture.

Figure 1A:
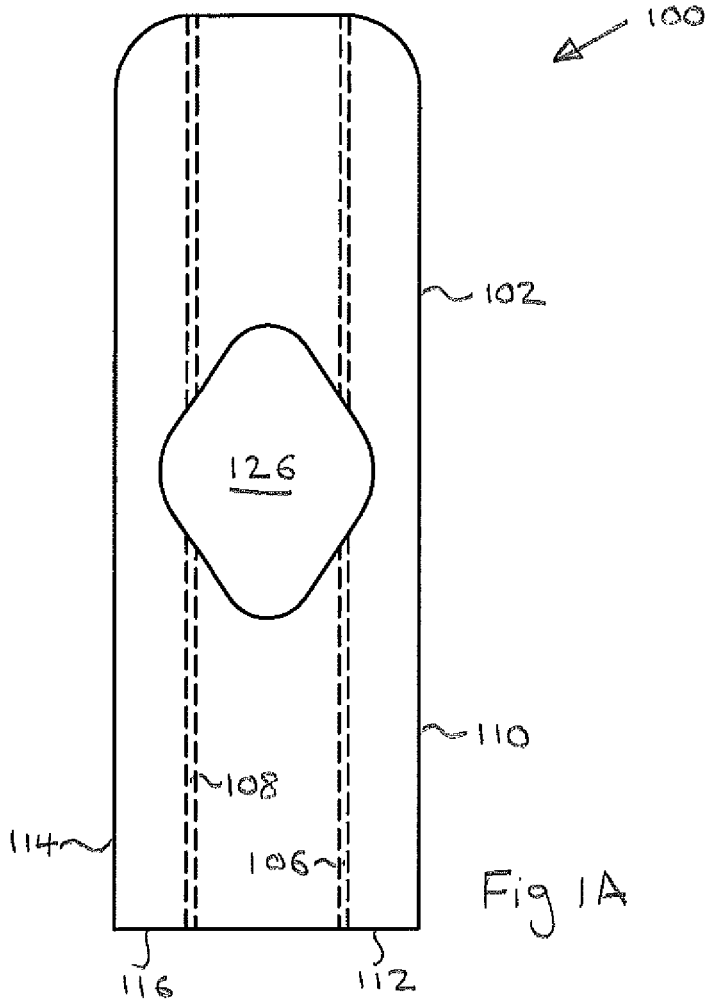
FIG. 1A illustrates a front elevation view of a holder according to a representative embodiment.
Figure 1B:
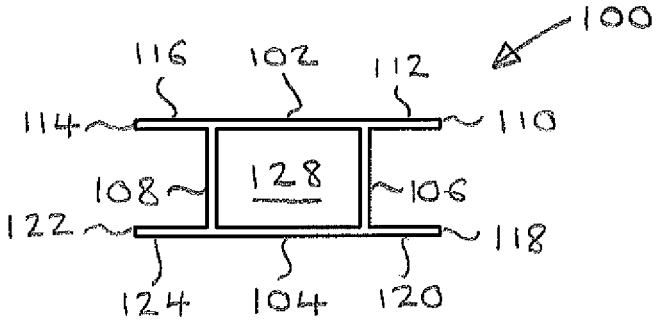
FIG. 1B illustrates a side elevation view of the holder of FIG. 1A.

With reference to FIGS. 1A and 1B, a holder 100 for a pipette having a bulb is described. The holder 100 comprises a front member 102, a back member 104, a first spacer 106 and a second spacer 108.

The first spacer 106 and the second spacer 108 are each connected between the front and back members 102, 104 to space apart the front member 102 and the back member 104. Specifically, the first spacer 106 is connected to the front member 102 away from a first edge 110 of the front member 102 to form a first flange 112 of the front member 102. The second spacer 108 is connected to the front member 102 away from a second edge 114 of the front member 102 to form a second flange 116 of the front member 102. Similarly, the first spacer 106 is connected to the back member 104 away from a first edge 118 of the back member 104 to form a first flange 120 of the back member 104. The second spacer 108 is connected to the back member 104 away from a second edge 122 of the back member 104 to form a second flange 124 of the back member 104.

The front member 102 comprises an aperture 126. The aperture 126 extends from the first flange 112 of the front member 102 to the second flange 116 of the front member 102 such that part of the aperture 126 is between the first spacer 106 and the second spacer 108. The aperture 126 is diamond-shaped (i.e. having pairs of mutually parallel sides) with rounded corners between sides. Two facing corners of the diamond shape are between the spacers and the other two facing corners extend into the respective flanges.

The front member 102, the back member 104, the first spacer 106 and the second spacer 108 together define a space for receiving the bulb of a pipette. The space has an opening 128 into which the bulb of the pipette can be inserted. In use, the bulb is inserted into the opening 128, and the bulb is retained in the holder by an interference fit. In some embodiments, however, the bulb is a clearance fit in the space and retained loosely by friction, retained against a stopper or detent, or glued into the holder.

In some embodiments, the first and second spacers 106, 108 are cut away in the region of the aperture 126. In use, the absence of structural support from the first and second spacers 106, 108 in the region of the aperture 126 enables the holder 100 to be more easily squeezed to apply force to the bulb of the pipette.

Figure 1C:
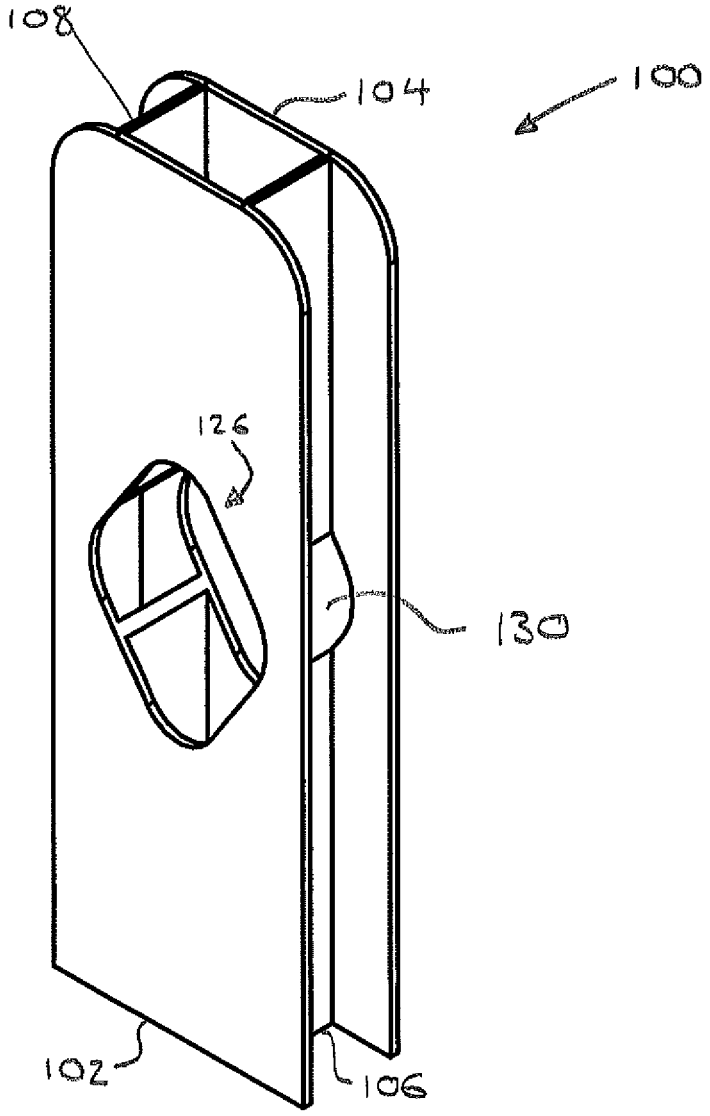
FIG. 1C illustrates a perspective view of the holder of FIG. 1A.

With reference to FIG. 1C, the back member 104 of the holder 100 comprises a second aperture 130. The second aperture 130 corresponds to (coincides with) the aperture 126 on the front member 102, and is substantially the same size and substantially the same shape as the aperture 126. The first and second spacers 106, 108 are cut away in the regions of the apertures 126, 130. In use, the absence of structural support from the first and second spacers 106, 108 in the regions of the apertures 126, 130 enables the holder 100 to be more easily squeezed to apply force to the bulb of the pipette.

In some embodiments, one of the apertures 126, 130 is omitted, so that there is only a single aperture in one of the front/back members. In these embodiments, the spacers may be cut as described above or remain intact, depending on the specific embodiment.

Figure 2:
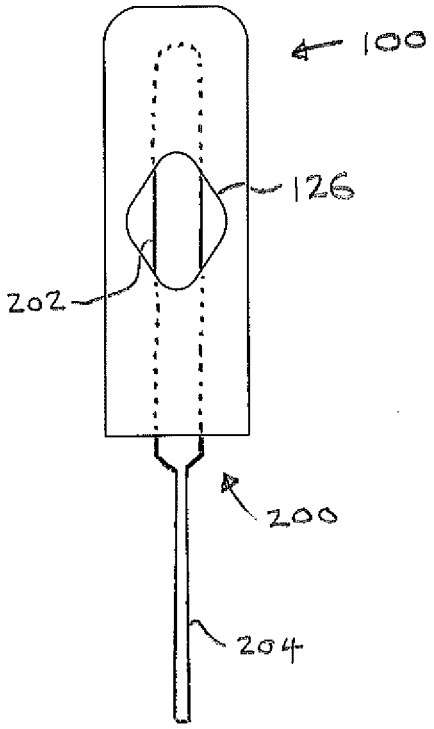
FIG. 2 illustrates a front elevation view of the holder of FIG. 1A in engagement with a pipette.

FIG. 2 illustrates a pipette 200 inserted into the holder 100. The pipette 200 comprises a bulb 202 and a stem 204. A central portion of the bulb 202 is accessible through the aperture 126. The pipette 200 is retained in the holder 100 and as such, the pipette 200 can be supported using the holder 100, for example, by holding the front and back members 102, 104 above or below the aperture 126. This enables the pipette 200 to be held without any application of force directly on the bulb 202. The bulb 202 can be actuated through the aperture 202 to take in and dispense liquid into and from the pipette.

With reference to FIGS. 3, 4, 5A and 5B, various embodiments are described illustrating different configurations for the aperture(s) and/or configuration of the front and back members. As for the embodiments described above with reference to FIGS. 1A to 1C, these embodiments may have an aperture, in one of the faces only, or an aperture in each face, and the spacers may be cut in the region of the aperture, or not.

Figure 3:
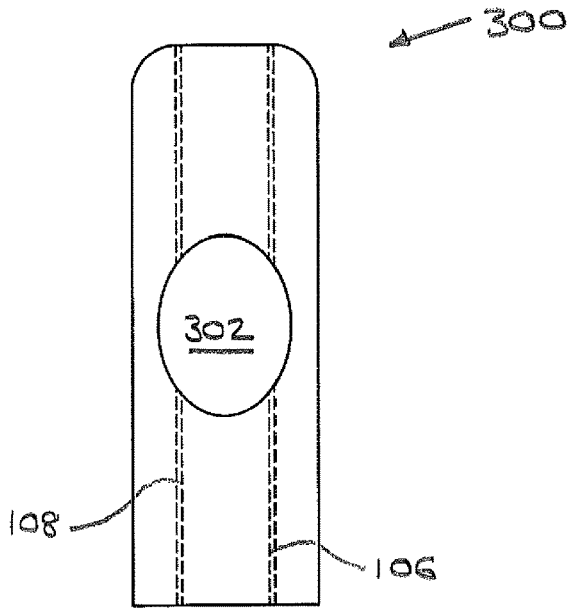
FIG. 3 illustrates a front elevation view of a holder according to another representative embodiment.

With reference to FIG. 3, a holder 300 is substantially the same as the holder 100. However, the holder 300 comprises an elliptical-shaped aperture 302, rather than the diamond-shaped aperture 126 of holder 100. As for the holder 100, the aperture extends in to the flanges 116, 112 (and 124, 120 as the case may be).

Figure 4:
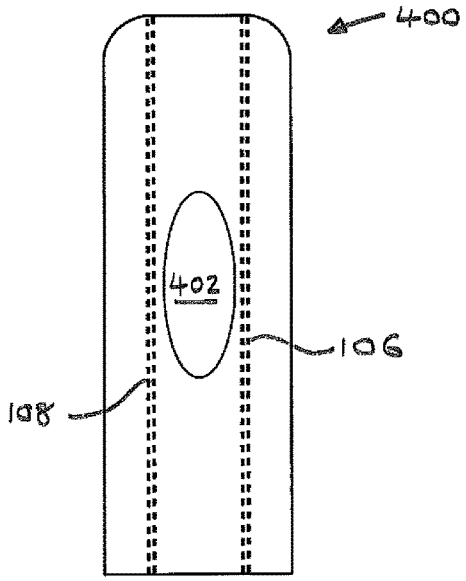
FIG. 4 illustrates a front elevation view of a holder according to another representative embodiment.

With reference to FIG. 4, a holder 400 is substantially the same as the holder 300. However, the holder 400 comprises an aperture 402 that is entirely between the first spacer 106 and the second spacer 108.

Figure 5A:
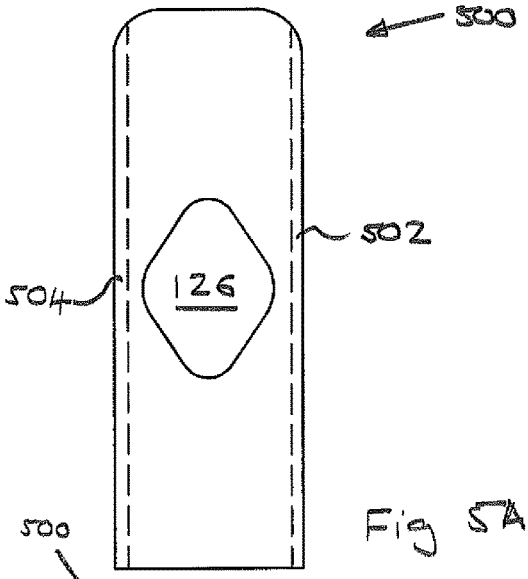
FIG. 5A illustrates a front elevation view of a holder according to another representative embodiment.
Figure 5B:
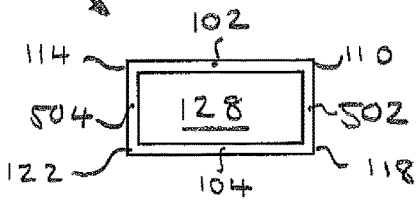
FIG. 5B illustrates a side elevation of the holder of FIG. 5A.

With reference to FIGS. 5A and 5B, a holder 500 is substantially the same as the holder 100. However, the holder 500 comprises a first spacer 502 and a second spacer 504 that connect to the edges of the front and back members 102, 104. Specifically, the first spacer 502 connects to the first edge 110 of the front member 102 and the first edge 118 of the back member 104. The second spacer 504 connects to the second edge 114 of the front member 102 and the second edge 122 of the back member 104. In other words, the holder 500 does not comprise any flanges.

Figure 6:
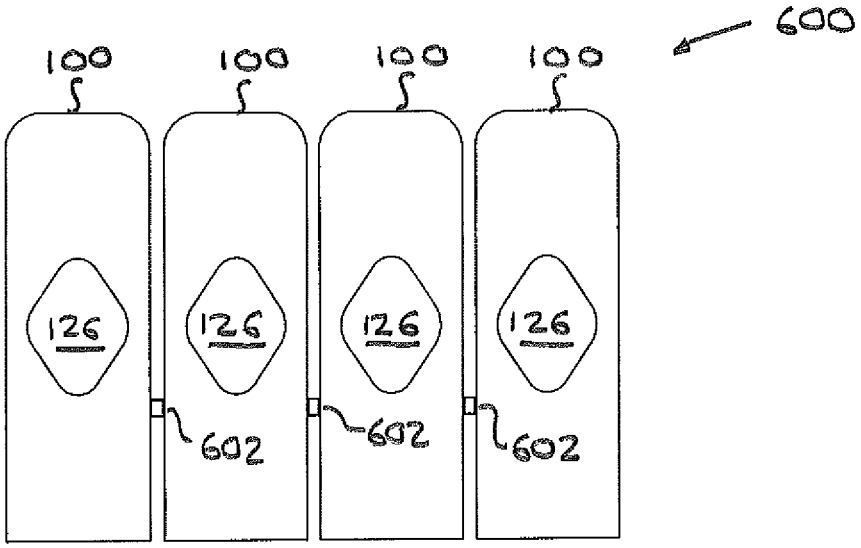
FIG. 6 illustrates a front elevation view of a sheet including a plurality of the holders of FIG. 1A connected together.

With reference to FIG. 6, a sheet 600 comprises a plurality of holders 100 arranged in a row. It will be appreciated that the holders 300, 400 and 500 may be arranged in a sheet in a similar fashion. In the sheet 600, pairs of adjacent holders 100 are connected to each other by a frangible connection 602 on the front member 102 and/or back member 104 of each holder 100. The plurality of holders do not need to be identical. For example, the plurality of holders may comprise a mixture of holders 100, 200, 300, 400 described with reference to FIGS. 1A, 1B, 1C to 4, 5A and 5B.

In some embodiments, the sheet 600 comprises a plurality of holders arranged in a plurality of rows and columns. In any given row, pairs of adjacent holders 100 are connected to each other by a frangible connection 602 on the front member 102 and/or back member 104 of each holder 100. Between rows, pairs of adjacent holders 100 are connected to each other by a frangible connection 602 on the front member 102 and/or back member 104 of each holder 100.

The sheet 600 may be manufactured from a single sheet of sheet material, for example a plastics sheet material such as alveolar sheet material. Laser cutting may be used in some embodiments to cut the plastic of the alveolar sheet.

Figure 7:
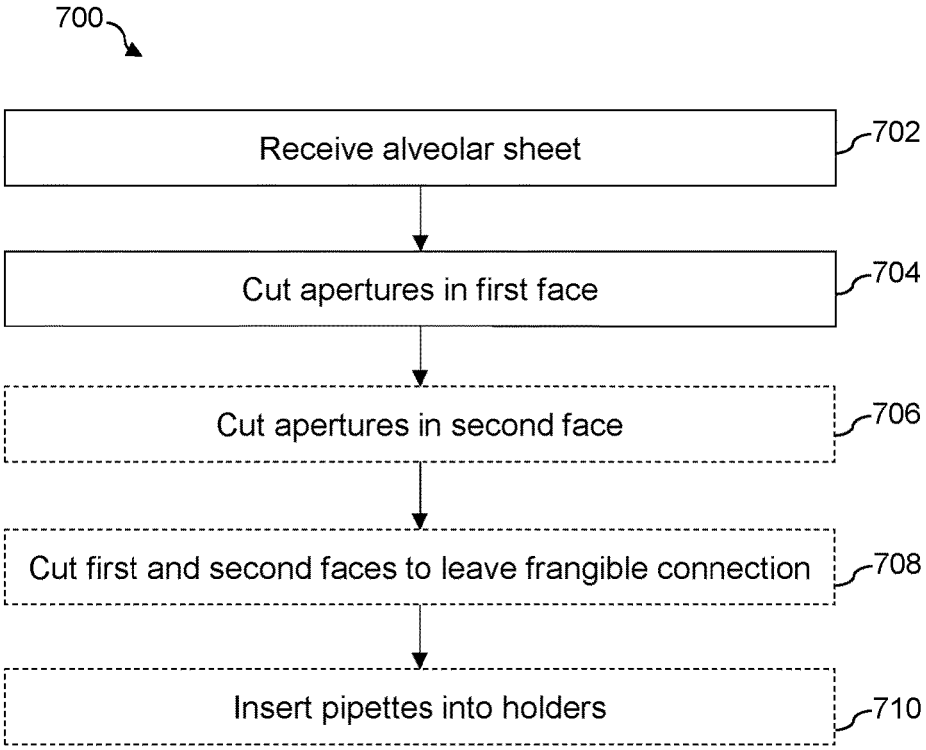
FIG. 7 illustrates a method of manufacturing a holder according to representative embodiments.

A method 700 of manufacturing a plurality of holders 100 (or 300, 400 or 500) is now described with reference to FIG. 7. At step 702, an alveolar sheet is received. The alveolar sheet comprises a front face, a back face, and a plurality of regularly-spaced spacers. Each of the plurality of spacers is connected between the front face and the back face to space apart the front face and the back face. The front face, the back face and pairs of adjacent spacers each define a space for receiving the bulb of the pipette.

At step 704, the front member is cut to form a plurality of apertures. At least part of each of the plurality of apertures is between two adjacent spacers. At optional step 706, the back member is cut to form a form a corresponding aperture for each of the plurality of apertures. In some embodiments, cutting step 704 and cutting step 706 are carried out in the same cutting action. For example, a laser cutting beam or a saw blade could pass through the front member and the back member in one cutting action to cut each of the plurality of apertures. In other words, the same single cutting action may be used to cut the apertures in the front and back faces by cutting through the thickness of the alveolar sheet to form each pair of apertures.

At step 708, the front face and the back face are cut between each aperture to form a frangible connection between each aperture. The corresponding cuts may be made as described above with single respective cutting actions to make pairs of cuts in the front and back faces. In some embodiments, the sheet is cut to completely separate the pipette holders, rather than leaving a frangible connection. Accordingly, a series of cuts in the alveolar sheet are made to form a plurality of pipette holders in the sheet. The frangible connections may be broken to separate the holders from the alveolar sheet. At optional step 710, a plurality of pipettes is inserted into the spaces defined between the front face, the back face and pairs of adjacent spacers in each holder, before or after breaking of any frangible connections. Thus, in some embodiments, a plurality of pipettes may be provided held in a sheet of pipette holders separated by frangible connections.

It is to be understood that the above description is intended to be illustrative, and not restrictive. Many other implementations will be apparent to those of skill in the art upon reading and understanding the above description. Although the present disclosure has been described with reference to specific example implementations, it will be recognized that the disclosure is not limited to the implementations described, but can be practiced with modification and alteration within the spirit and scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

For example, the skilled person would understand that a plurality of pipette holders could be manufactures using methods that do not involve starting from a sheet material. Individual holders, or sheets comprising a plurality of holders in which pairs of adjacent holders are connected by a frangible connection, could be made by injection moulding, for example. Other possibilities include gas assisted injection moulding of the entire part, i.e. a plastic pipette with a reinforced bulb (or a sheet comprising a plurality of holders and pipettes). In this case, the front and back members could correspond to thicker extensions of the walls of the plastic bulb in some arrangements. The spacers and the aperture could correspond to thinner walls of the plastic bulb in these arrangements. Likewise, the cross-section of the bulb could have a various shapes, for example rectangular, ovoid, and the like and the shapes of the cut-out, receiving space and external profile of the pipette holder may also take various shapes in dependence on specific embodiments and applications.

The invention claimed is:

1. A holder for retaining a pipette having a bulb, the holder comprising:

a front member defining a first aperture;

a back member; and a first spacer and a second spacer each connected to the front member and the back member to space apart the front member and the back member, wherein at least part of the first aperture is between the first spacer and the second spacer and wherein the front member, the back member, the first spacer and the second spacer define a space for receiving the bulb of the pipette wherein the first spacer is connected to the front member away from a first edge of the front member to form a first flange, and the second spacer is connected to the front member away from a second edge of the front member to form a second flange, and wherein at least part of the first aperture is in the first flange and the second flange.

2. The holder of claim 1, wherein the back member defines a second aperture at least partially between the first spacer and the second spacer.

3. The holder of claim 2, wherein the second aperture substantially coincides with the first aperture.

4. The holder of claim 1, wherein the first and second edges of the front member each comprise a remainder of a frangible connection.

5. The holder of claim 1, wherein the first aperture comprises four sides and rounded corners between adjacent sides.

6. The holder of claim 1, wherein the first aperture comprises four sides and rounded corners between adjacent sides, and wherein two facing corners are between the first and second spacers and the two facing corners extend into the respective flanges.

7. A sheet comprising a plurality of holders according to claim 1, wherein pairs of adjacent holders are spaced apart by a frangible connection.

8. A kit comprising:

a holder for retaining a pipette having a bulb, the holder comprising:

a front member defining a first aperture;

a back member; and a first spacer and a second spacer each connected to the front member and the back member to space apart the front member and the back member, wherein at least part of the first aperture is between the first spacer and the second spacer and wherein the front member, the back member, the first spacer and the second spacer define a space for receiving the bulb of the pipette; and the pipette having a bulb, and wherein the bulb of the pipette is an interference fit in the space defined by the front member, the back member, the first spacer and the second spacer.

9. The kit of claim 8, wherein the pipette is a transfer pipette.

10. The kit of claim 8, wherein the pipette comprises a stem with an internal dimension sized such that liquid may be drawn into the stem by capillary action.

11. The kit of claim 8, wherein the first spacer is connected to the front member away from a first edge of the front member to form a first flange, and the second spacer is connected to the front member away from a second edge of the front member to form a second flange.

12. The kit of claim 11, wherein at least part of the first aperture is in the first flange and the second flange.

13. The kit of claim 8, wherein the back member defines a second aperture at least partially between the first spacer and the second spacer.

14. The kit of claim 13, wherein the second aperture substantially coincides with the first aperture.

* * * * *